US011530576B2

(12) United States Patent
Lyles et al.

(10) Patent No.: US 11,530,576 B2
(45) Date of Patent: Dec. 20, 2022

(54) DRILL BIT WITH HYBRID CUTTING ARRANGEMENT

(71) Applicant: Taurex Drill Bits, LLC, Norman, OK (US)

(72) Inventors: Dustin Lyles, Norman, OK (US); Matthew Mumma, Norman, OK (US); Ryan Mathews, Norman, OK (US); Terry Vance Morris, Tuttle, OK (US)

(73) Assignee: TAUREX DRILL BITS, LLC, Norman, OK (US)

( * ) Notice: Subject to any disclaimer, the term of this patent is extended or adjusted under 35 U.S.C. 154(b) by 186 days.

(21) Appl. No.: 16/818,287

(22) Filed: Mar. 13, 2020

(65) Prior Publication Data

US 2020/0291726 A1 Sep. 17, 2020

Related U.S. Application Data

(60) Provisional application No. 62/818,930, filed on Mar. 15, 2019.

(51) Int. Cl.

| | |
|---|---|
| ***E21B 10/43*** | (2006.01) |
| ***E21B 10/567*** | (2006.01) |
| ***E21B 29/00*** | (2006.01) |

(52) U.S. Cl.

CPC ..... *E21B 10/43* (2013.01); *E21B 10/5673* (2013.01); *E21B 29/00* (2013.01)

(58) Field of Classification Search

CPC ..... E21B 10/43; E21B 29/00; E21B 29/08
USPC ..... 175/428
See application file for complete search history.

(56) References Cited

U.S. PATENT DOCUMENTS

| | | | | |
|---|---|---|---|---|
| 4,499,958 | A * | 2/1985 | Radtke | E21B 10/602 175/413 |
| 5,038,859 | A | 8/1991 | Lynde et al. | |
| 7,178,609 | B2 * | 2/2007 | Hart | E21B 10/55 166/298 |
| 7,958,940 | B2 | 6/2011 | Jameson | |
| 8,177,001 | B2 * | 5/2012 | McClain | E21B 10/485 175/431 |
| 8,985,246 | B2 | 3/2015 | Lynde | |
| 2006/0162966 | A1 * | 7/2006 | Richert | E21B 10/46 175/348 |
| 2009/0266619 | A1 * | 10/2009 | Durairajan | E21B 10/43 175/431 |
| 2010/0155149 | A1 * | 6/2010 | Keshavan | E21B 10/43 175/428 |

(Continued)

FOREIGN PATENT DOCUMENTS

EP 2910272 A1 8/2015

*Primary Examiner* — Abby J Flynn
*Assistant Examiner* — Ronald R Runyan
(74) *Attorney, Agent, or Firm* — Vorys, Sater, Seymour and Pease LLP

(57) ABSTRACT

A drill bit includes a bit body providing one or more blades and defining a cone section extending from a centerline of the bit body a first distance, a nose section extending from the cone section a second distance, a shoulder section extending from the nose section a third distance, and a gauge section extending from the shoulder section a fourth distance. The drill but further includes one or more cutting elements mounted to the one or more blades outside of the cone section such that the cone section is void of cutting elements, and a plurality of milling elements secured to the bit body within the cone section.

14 Claims, 8 Drawing Sheets

(56) References Cited

U.S. PATENT DOCUMENTS

| | | | | |
|---|---|---|---|---|
| 2015/0226010 | A1* | 8/2015 | Drews | E21B 10/55<br>175/432 |
| 2017/0234092 | A1* | 8/2017 | Howard | E21B 29/00<br>166/376 |
| 2018/0291689 | A1 | 10/2018 | Palmer et al. | |

* cited by examiner

DRILL BIT WITH HYBRID CUTTING ARRANGEMENT

BACKGROUND

In the oil and gas industry, drill bits are commonly used to drill wellbores or boreholes. To accomplish this, a drill bit is attached to the end of a string of drill pipe (i.e., a "drill string") and rotated to grind and cut through the underlying rock and subterranean formations of the earth. As the drill bit advances into the earth, a drilling fluid (e.g., water, drilling mud, etc.) is typically pumped down the drill string and discharged at the drill bit to cool and lubricate the drill bit. The drilling fluid also helps carry fragments or cuttings removed by the drill bit up the annulus and out of the wellbore.

Recent advancements in drilling practices have resulted in wellbores that include lateral or horizontal sections extending thousands of feet laterally away from the drilling rig. Before producing hydrocarbons (i.e., oil, natural gas, etc.) along these lateral wellbore sections, they typically need to be perforated and hydraulically fractured across any number of production zones. Each production zone is isolated from adjacent zones and other parts of the wellbore by strategically deploying wellbore isolation devices at desired locations along the wellbore. Examples of typical wellbore isolation devices include packers, bridge plugs, and hydraulic fracturing plugs (commonly referred to as "frac plugs").

While some wellbore isolation devices are retrievable after use (or dissolvable), most are designed to be drilled or milled out with its constituent parts being circulated out of the wellbore with the circulating drilling fluid. Different types of drill bits have been used and designed to mill out (or drill through) wellbore isolation devices. The most common drill bit types are roller cone bits and fixed cutter bits. Roller cone drill bits include one or more rotating cones with cutting elements, or teeth, on each cone. Roller cone drill bits typically have a relatively short life span as the cutting elements and support bearings for the roller cones typically wear out and fail after short periods of drilling use.

Polycrystalline diamond compact bits (or "PDC bits") are one type of fixed cutter bit. PDC bits include a plurality of cutters (or "cutting elements") attached to one or more fixed blades. The cutting elements can be made of a variety of hard or ultra-hard materials, such as polycrystalline diamond, tungsten carbide, thermally stable polycrystalline (TSP), natural or synthetic diamond, or any combination thereof. Each cutter is typically received within and bonded to a dedicated cutter pocket machined or cast into a high strength bit body. The result is a highly abrasion and impact resistant cutting element cemented into a dedicated pocket with high shear strength. Based on force analysis and cut profile modeling, the cutter pockets are strategically placed on the bit body to optimize performance and durability. Cutting elements are often arranged to create cutting redundancy in portions of the bit profile where the majority of bit damage is likely to be sustained.

Mills (also referred to as "carbide mills" or "junk mills") are a second type of fixed cutter bit. Mills include highly wear-resistant cutting elements brazed or hardfaced to a high strength bit body. Mill cutting elements (or "milling elements") commonly include crushed or sintered carbide elements that exhibit a sharp and jagged geometry. Instead of placing the milling elements within precisely machined pockets, as with PDC bit design, the milling elements are typically attached to the outer surface of the mill body by hand, which can result in a high degree of inconsistency.

Consequently, milling elements lack a support structure and are instead suspended in a matrix of surrounding milling elements bonded in place by braze or hardfacing. Milling elements are subject to loss due to the high shear forces encountered during the milling operation.

One of the primary challenges in drilling or milling wellbore isolation devices is limiting the size of cuttings that are generated during the milling process. Large cuttings are difficult to circulate out of the wellbore and can potentially plug flow lines and choke pump equipment. In addition, large cuttings can potentially bind the drill string and often require time-consuming wiper trips or costly sweeps with fluid additives to evacuate dense cutting beds. In a worst case scenario, the drill string would be stuck in the wellbore and require abandoning expensive tools and components downhole, thus limiting production capacity. An additional challenge to milling wellbore isolation devices is that wellbore isolation devices are commonly manufactured from a variety of materials, including various metals, composites, ceramics, and elastomeric (e.g., resilient) elements, and each material has significant differences in strengths. If the bit cutting structure is not sufficiently durable to drill all wellbore isolation devices in a single run, the drill bit must be pulled from the wellbore and replaced.

PDC bits typically generate more reactive torque and produce larger cuttings as compared to mills due to the shearing nature of the PDC cutting mechanics and the traditionally blunt cutting edge of the PDC cutting elements. In contrast, mills typically generate finer cuttings since milling elements commonly have sharp edges and are placed in asymmetric or random configurations across the face of the mill. These sharper cutting structures create a low depth of cut producing chipping and shredding effect that produces smaller cuttings of the more ductile materials of the wellbore isolation device. However, mill durability does not match that of a PDC bit due to limitations of materials, manufacturing techniques, and shear strength limitations of the binder material.

Thus, there exists a need for a hybrid drill bit configuration that reduces cutting sizes while simultaneously maximizes durability.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to drill bits and, more particularly, to drill bits designed to efficiently drill and/or mill wellbore equipment, such as wellbore isolation devices.

Wellbore isolation devices, such as bridge plugs and frac plugs, are commonly manufactured from a variety of materials, including various metals, ceramics, and elastomeric (e.g., resilient) elements. A typical wellbore isolation device includes a main body made of cast iron or another easily drillable (millable) material. One or more packing elements encircle the body and are actuatable to form a hydraulic seal within the wellbore. The packing elements have a diameter small enough to be lowered into the wellbore, but are expandable to engage the inner wall of the wellbore (or casing) and create a seal between the wellbore isolation device and the wellbore (or casing). The packing elements are typically made of an elastomer that is squeezed to expand during the setting operation, though inflatable packing elements can also be used.

To prevent the wellbore isolation device from moving within the wellbore once set, elements called "slips" are commonly positioned along the outer diameter of the tool and are forced radially outward to engage and dig into the inner wall of the wellbore (or casing) and thereby anchor the wellbore isolation device axially in position. The slips are typically made of hard materials, such as steel, cast iron, ceramic, or tungsten carbide.

Some wellbore isolation devices, commonly referred to as "composite plugs," are primarily made of composite materials and plastics rather than metals, which make it easier to mill such wellbore isolation devices. Composite materials, however, are not suitable for all elements of a wellbore isolation device, since the slips must be made of a harder substance that will sufficiently engage and grip the inner wall of the wellbore (or casing) when actuated.

Accordingly, wellbore isolation devices typically include softer materials (elastomers and composites) throughout the length of the wellbore isolation device in the inner diameter as well as the outer diameter, and the slips are placed solely on the outer diameter of the wellbore isolation device. Consequently, the radially outward portions of a drill bit profile (e.g., nearest the gauge section) typically experience the most damage while cutting through the slips and therefore benefits the most from highly durable PDC bit designs and cutting elements. Conversely, the relatively softer composite and elastomeric materials that make up the inner portion of the wellbore isolation device and the additional wellbore isolation device length can be more efficiently drilled by the sharper, more aggressive cutting elements of a mill with little concern for durability.

Figure 1A:
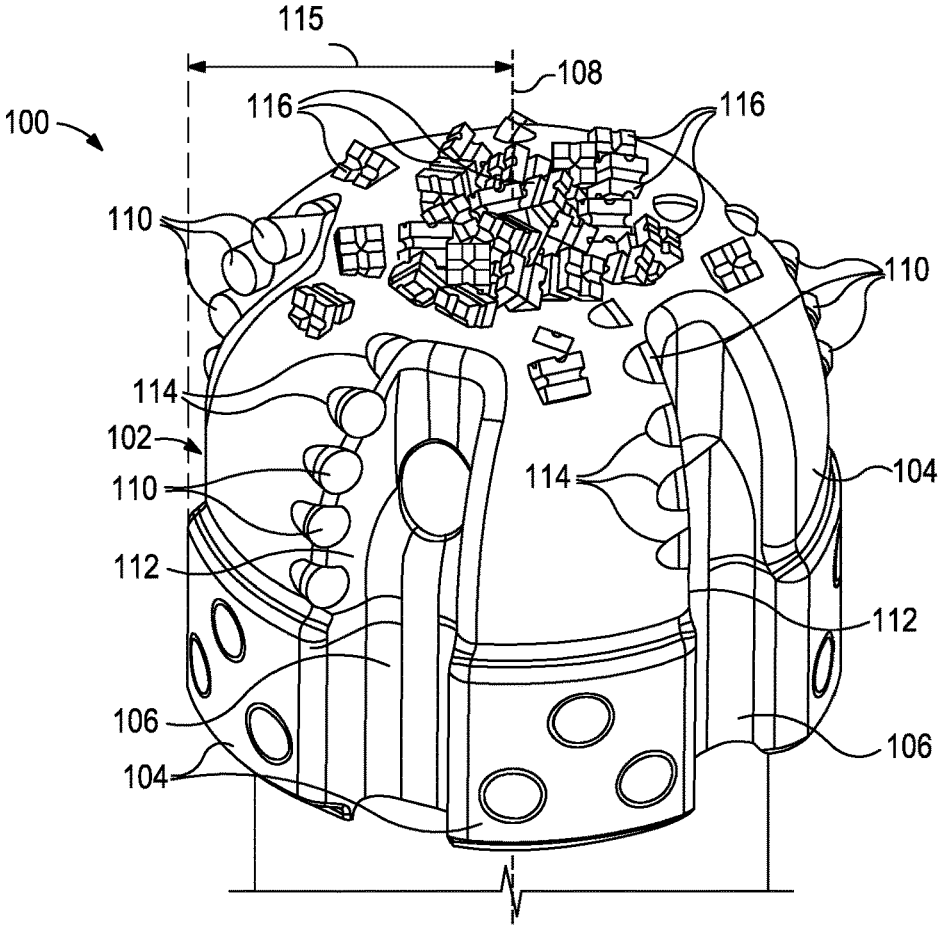
FIGS. 1A and 1B are isometric and top views, respectively, of an example drill bit that may incorporate one or more principles of the present disclosure.
Figure 1B:
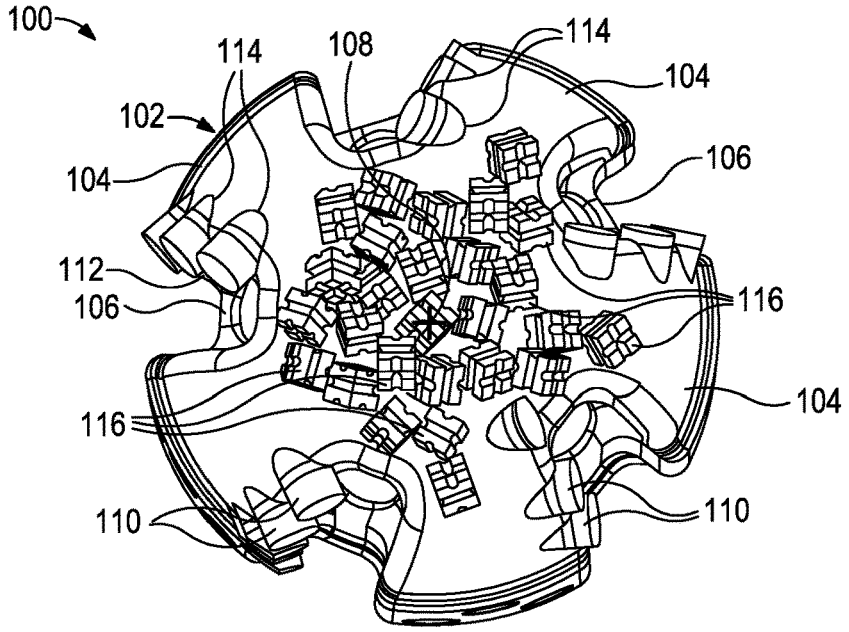

FIGS. 1A and 1B are isometric and top views, respectively, of an example drill bit 100 that may incorporate one or more principles of the present disclosure. The drill bit 100 may be connectable to a length of drill pipe forming part of a drill string, and the drill string may be coupled to a source of rotary torque or force, such as a motor, a downhole motor, a top drive, or a kelly drive of a drilling rig at a surface location.

As illustrated, the drill bit 100 includes a bit body 102 that provides or otherwise defines one or more drill bit blades 104 separated by junk slots 106. In the illustrated embodiment, the blades 104 and the junk slots 106 do not extend to a centerline 108 of the bit body 102, but may alternatively extend to the centerline 108 in other embodiments, as discussed below, without departing from the scope of the disclosure. The bit body 102 can be formed integrally with the blades 104, such as being milled out of a steel blank. Alternatively, the blades 104 can be welded to the bit body 102. In other embodiments, the bit body 102 and the blades 104 may be formed of a matrix material sintered in a mold of a desired shape, typically a tungsten carbide matrix with an alloy binder, with the blades 104 also being integrally formed of the matrix with the bit body 102.

Figure 2:
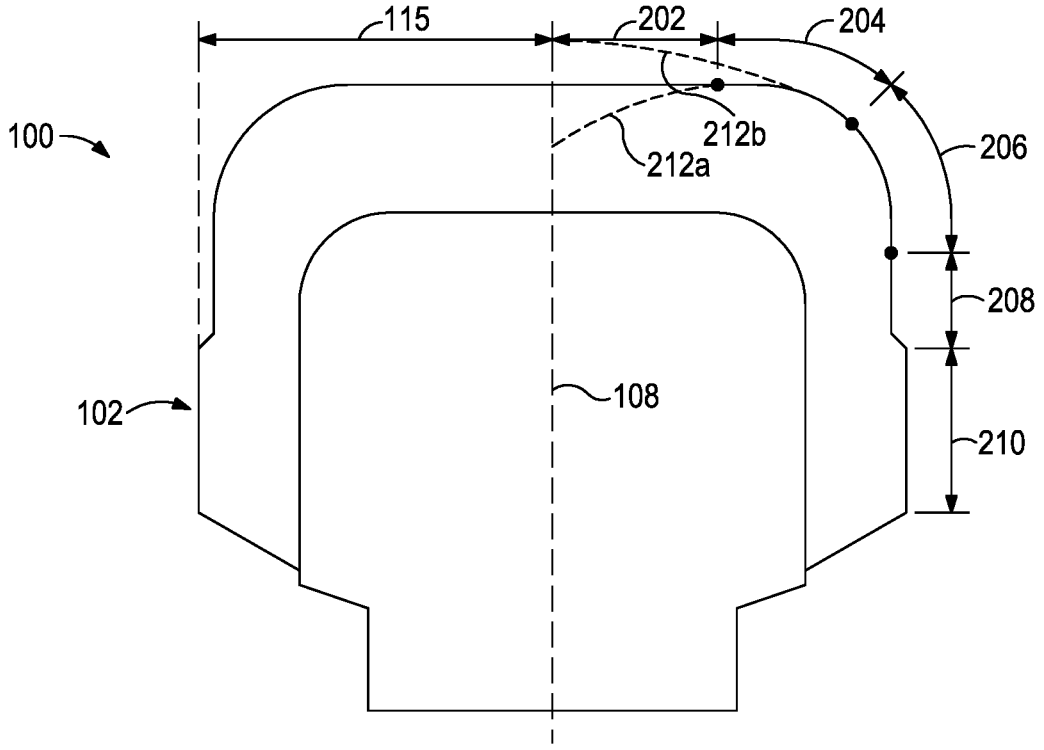
FIG. 2 is a schematic representation of the drill bit of FIGS. 1A-1B.

Referring briefly to FIG. 2, illustrated is a schematic representation of the profile of the drill bit 100. As illustrated, the bit body 102 includes a cone section 202, a nose section 204, a shoulder section 206, and a gauge section 208. The bit body 102 may also define or otherwise provide a gauge pad 210 that generally extends from the gauge section 208. The cone, nose, shoulder, and gauge sections 202-208 form contiguous portions of the bit profile extending radially outward from the centerline 108. More specifically, the cone section 202 extends from the centerline 108 a first distance, the nose section 204 extends from the cone section 202 a second distance, the shoulder section 206 extends from the nose section 204 a third distance, and the gauge section 208 extends from the shoulder section 206 a fourth distance.

In some embodiments, as illustrated, the cone and nose sections 202, 204 may be generally planar (e.g., substantially flat) across the distal end of the bit body 102. In other embodiments, however, at least the cone section 202 may curve inward (concave) and toward the centerline 108 of the bit body 102, as indicated by the dashed line 212*a*. In yet other embodiments, at least the cone section 202 may curve outward (convex) and toward the centerline 108, as indicated by the dashed line 212*b*, without departing from the scope of the disclosure.

Referring again to FIGS. 1A-1B, the drill bit 100 includes one or more cutting elements 110 mounted to a leading face 112 of each blade 104. More specifically, each cutting element 110 may be received within and bonded to a dedicated cutter pocket 114 that is machined or cast into the bit body 102 at the corresponding blade 104. In some embodiments, one or more of the cutting elements 110 may include a cutting table or face bonded to a substrate. The cutting face may be made of a variety of hard or ultra-hard materials such as, but not limited to, polycrystalline diamond (PCD), sintered tungsten carbide, thermally stable polycrystalline (TSP), polycrystalline boron nitride, cubic boron nitride, natural or synthetic diamond, hardened steel, or any combination thereof. The substrate may also be made of a hard material, such as tungsten carbide or ceramic. In other embodiments, however, one or more of the cutting elements 110 may not incorporate a cutting table. In such embodiments, the cutting elements 110 may comprise sintered tungsten carbide inserts without a cutting table and bonded to corresponding cutter pockets 114.

In the illustrated embodiment, the cutting elements 110 are arranged on the bit body 102 outside of the cone section 202 (FIG. 2), thus the cone section 202 is void of cutter pockets 114. More specifically, the cutting elements 110 may be positioned on the bit body 102 primarily within the shoulder and gauge sections 206, 208 (FIG. 2). In at least one embodiment, however, one or more of the cutting elements 110 may be positioned within the nose section 204 (FIG. 2) of the bit body 102. Said differently, in some embodiments, the cutting elements 110 may be positioned on the outer ½ of a radius 115 (see FIGS. 1A and 2) of the bit body 102 extending from the centerline 108, but are not present (void) within the inner ½ of the bit radius 115 (closer to the centerline 108). In other embodiments, the cutting elements 110 may be positioned on the bit body 102 on the outer ¼ of the bit radius 115 extending from the centerline 108, but are not present (void) within the inner ¾ of the bit radius 115. In yet other embodiments, the cutting elements 110 may be positioned on the bit body 102 on outer ⅛ of the bit radius 115 extending from the centerline 108, but are not present (void) within the inner ⅞ of the bit radius 115.

The drill bit 100 may further include a plurality of milling elements 116 mounted or otherwise secured to the bit body 102. The milling elements 116 may comprise chunks, pieces, or segments of highly wear-resistant materials having jagged or sharp geometry. In some embodiments, the milling elements 116 may be polygonal in shape, such as cubic or rectangular prismatic, and may be oriented on the bit body 102 in an irregular orientation such that corners of such milling elements 116 protrude away from the bit body 102. Suitable materials for the milling elements 116 include, but are not limited to, polycrystalline diamond (PCD), tungsten carbide, thermally stable polycrystalline (TSP), polycrystalline boron nitride, cubic boron nitride, natural or synthetic diamond, hardened steel, or any combination thereof. In some embodiments, some or all of the milling elements 116 may be brazed, hardfaced, or welded to flat, outer surfaces of the bit body 102. In other embodiments, however, some of the milling elements 116 may be cast into the bit body 102. The milling elements 116 may incorporate two or more distinct materials and may vary in size, material composition, and shape.

In the illustrated embodiment, the milling elements 116 are arranged on the bit body 102 adjacent the centerline 108 and primarily situated within the cone section 202 (FIG. 2). In some embodiments, some milling elements 116 may also be positioned within the nose, shoulder, and gauge sections 204, 206, 208, without departing from the scope of the disclosure. In one or more embodiments, the milling elements 116 occupy a greater portion of the bit radius 115 as compared to the cutting elements 110. In the illustrated embodiment, the milling elements 116 are arranged randomly (asymmetrically) within the cone section 202, but could alternatively be arranged in a predetermined pattern or design.

In some embodiments, as illustrated, the position or arrangement of some of the cutting and milling elements 110, 116 may angularly overlap partially in at least one of the bit profile sections. In the illustrated embodiment, for example, both cutting and milling elements 110, 116 are arranged within the nose section 204 and otherwise occupy the same radial line about the circumference of the bit body 102. Placement of the cutting and milling elements 110, 116 may alternate in an angular direction extending about the circumference of the bit body 102 at specific radial locations within the nose section 204. In the illustrated embodiment, one or more cutting elements 110 arranged on one bit blade 104 are angularly followed by one or more milling elements 116 on the same bit blade 104, which are angularly followed by one or more additional cutting elements 110 arranged on another angularly adjacent bit blade 104. As a result, when the bit body 102 rotates during operation, the milling elements 116 will track the cutting elements 110 in the same radial line, thus serving as secondary or back-up cutters. In such embodiments, the cutting elements 110 with the dedicated pockets 114 act as the primary cutting structure on the leading edge 112 of the blade 104. Other alternating patterns of cutting and milling elements 110, 116 are contemplated herein, as described below.

The drill bit 100 may prove advantageous in milling and/or drilling out wellbore isolation devices, which typically include harder materials (e.g., slips, etc.) near the outer diameter of the wellbore isolation device, and softer materials near the inner diameter. More specifically, the cutting elements 110 in the drill bit 100 are positioned primarily near the outer diameter of the bit body 102, such as within the shoulder and gauge sections 206, 208 (FIG. 2), thus being in position to engage and mill through the harder materials of wellbore isolation devices anchored within a wellbore. In contrast, the milling elements 116 are generally positioned nearer to or adjacent the centerline 108, such as within the cone and nose sections 202, 204 (FIG. 2), thus being positioned to engage and mill through the softer materials of the wellbore isolation devices.

Figure 3:
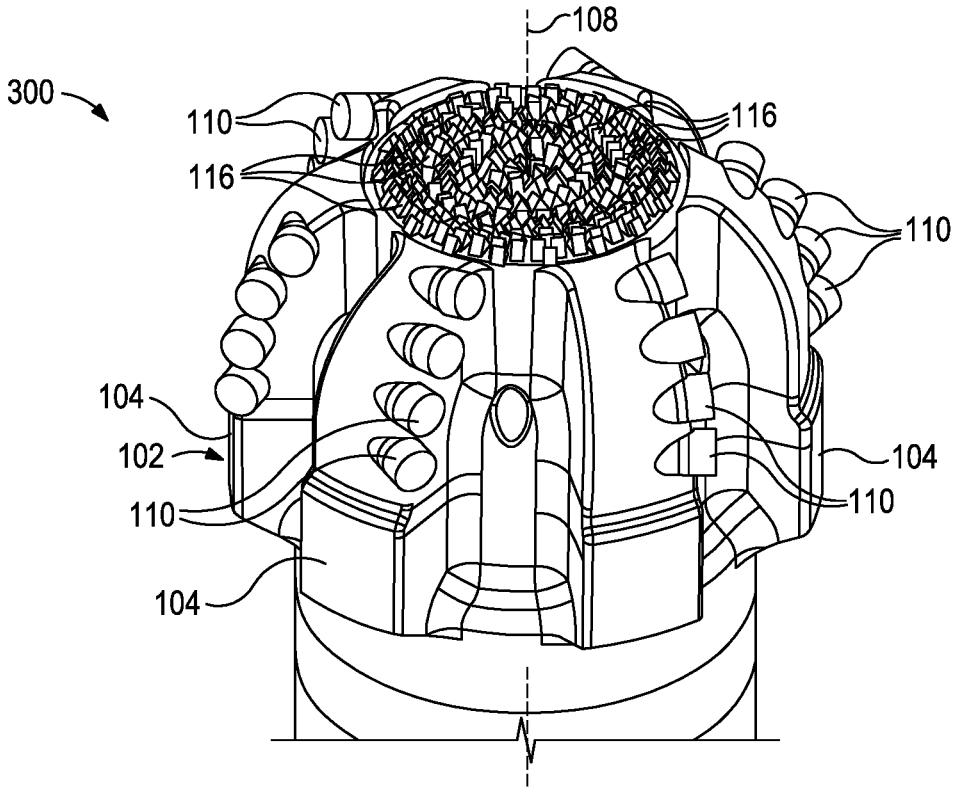
FIG. 3 depicts another example drill bit, according to one or more additional embodiments.

FIG. 3 depicts another example drill bit 300, according to one or more additional embodiments. The drill bit 300 may be similar in some respects to the drill bit 100 of FIGS. 1A-1B and therefore may be best understood with reference thereto, where like numerals will represent like components not described again in detail. Similar to the drill bit 100, for instance, the drill bit 300 includes the bit body 102, the blades 104, and one or more cutting elements 110 mounted to the blades 104. Moreover, the cutting elements 110 may be positioned on the bit body 102 outside of the cone section 202 (FIG. 2), and primarily within the shoulder and gauge sections 206, 208 (FIG. 2). The drill bit 300 may further include the plurality of milling elements 116 mounted to the bit body 102 adjacent the centerline 108 and primarily within the cone section 202 (FIG. 2).

Unlike the drill bit 100 of FIGS. 1A-1B, however, which include a random arrangement or positioning of the milling elements 116, the milling elements 116 included with the drill bit 300 may be arranged in a predetermined pattern or array. In at least one embodiment, as illustrated, the milling elements 116 may be arranged symmetrically in concentric circles extending radially outward from the centerline 108 of the bit body 102. This arrangement of the milling elements 116 may prove advantageous in accommodating a mill element geometry that would allow for maximum density of the milling elements 116. In other embodiments, however, other predetermined patterns or arrays of the milling elements 116 may be provided on the drill bit 300, such as an interlocking manner with certain geometries or in straight rows along the leading edge 112 of the blade 104 in order to maximize density of the milling elements 116.

Figure 4A:
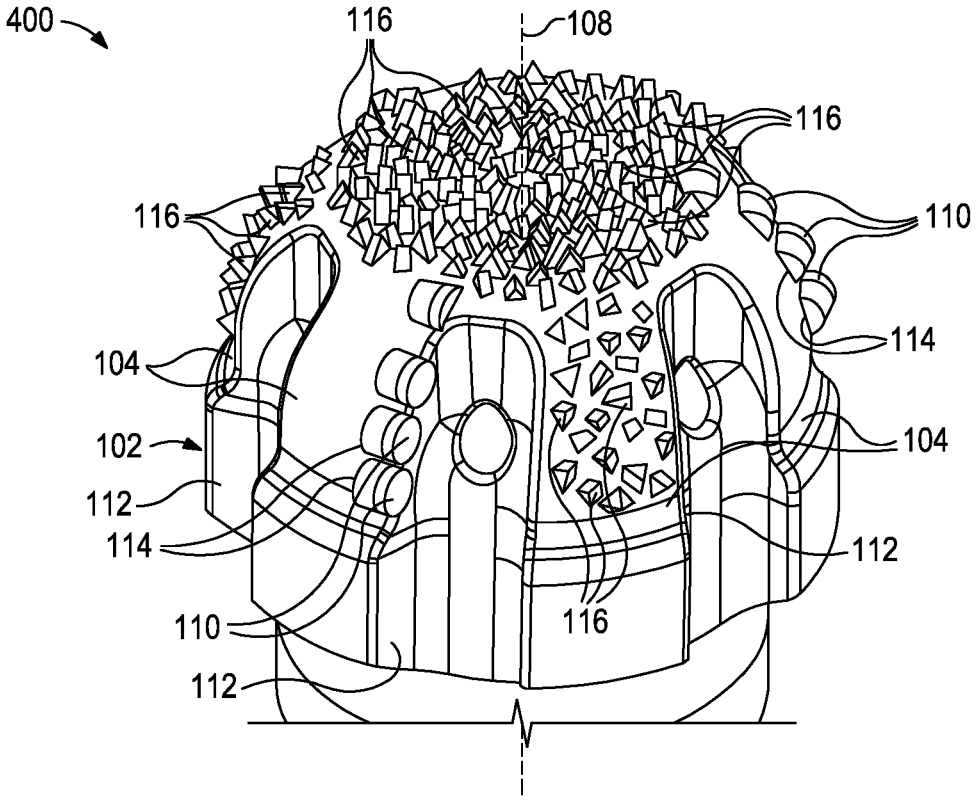
FIGS. 4A and 4B are isometric and top views, respectively, of another example drill bit that may incorporate one or more principles of the present disclosure.
Figure 4B:
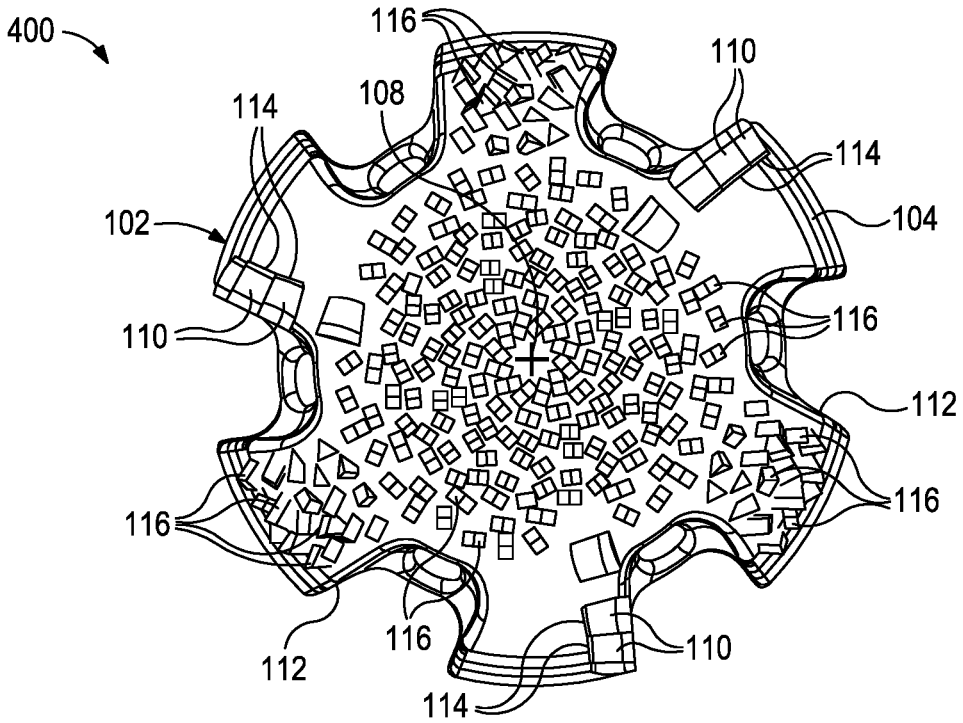

FIGS. 4A and 4B are isometric and top views, respectively, of another example drill bit 400 that may incorporate one or more principles of the present disclosure. The drill bit 400 may be similar in some respects to the drill bit 100 of FIGS. 1A-1B and therefore may be best understood with reference thereto, where like numerals will represent like components not described again in detail. Similar to the drill bit 100, for instance, the drill bit 400 includes the bit body 102, the blades 104, and one or more cutting elements 110 mounted to the leading face 112 of one or more of the blades 104 within corresponding cutter pockets 114. The cutting elements 110 may be present on the bit body 102 outside of the cone section 202 (FIG. 2), and primarily within the shoulder and gauge sections 206, 208 (FIG. 2). Accordingly, the cone section 202 may be substantially void of cutter pockets 114. In at least one embodiment, however, one or more of the cutting elements 110 may be positioned within the nose section 204 (FIG. 2). The drill bit 400 may further include the plurality of milling elements 116 mounted to the bit body 102 adjacent the centerline 108 and primarily within the cone section 202 (FIG. 2).

In contrast to the drill bit 100 of FIGS. 1A-1B, however, the cutting elements 110 of the drill bit 400 may be positioned on some but not all of the blades 104. More specifically, the cutting elements 110 and the associated cutter pockets 114 may be provided on alternating blades 104 about the circumference of the bit body 102. Moreover, some of the milling elements 116 may be positioned within the shoulder and gauge sections 206, 208 (FIG. 2) on some but not all of the blades 104. Consequently, at least some of the milling elements 116 may be arranged at the leading face 112 of the corresponding blade 104 to serve as a primary cutter. In the illustrated embodiment, the arrangement of the cutting elements 110 and the milling elements 116 on the blades 104 may alternate, where one blade 104 includes only cutting elements 110, and an angularly adjacent blade 104 includes only milling elements 116. Accordingly, every other blade 104 provides cutter pockets 114 for the cutting elements 110, while the other blades are void of cutter pockets 114 and cutting elements 110 and instead have milling elements 116 secured thereto.

The drill bit 400 may be useful in milling and/or drilling out wellbore isolation devices having harder materials (e.g., slips, etc.) near their outer diameter. The drill bit 400, however, may further prove advantageous in helping to better mill the harder materials near the outer diameter with some of the milling elements 116 being positioned on the blades 104 near the outer diameter of the bit body 102. This may allow the milling elements 116 to grind larger chunks of the harder materials of the wellbore isolation devices into smaller pieces more suitable for recirculation out of the wellbore. This embodiment also provides economic advantages by allowing the use of more expensive cutting elements only as needed to meet specific application durability requirements, and thus taking advantage of less expensive milling elements when possible.

Figure 5A:
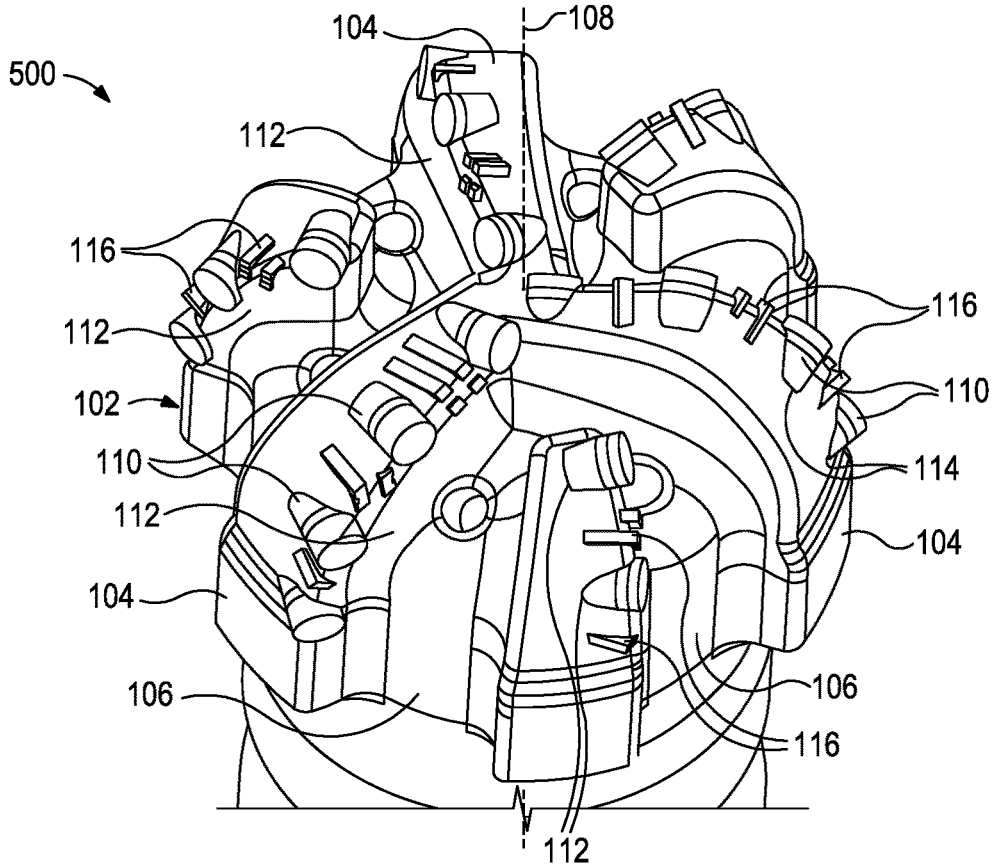
FIGS. 5A and 5B are isometric and top views, respectively, of another example drill bit that may incorporate one or more principles of the present disclosure.
Figure 5B:
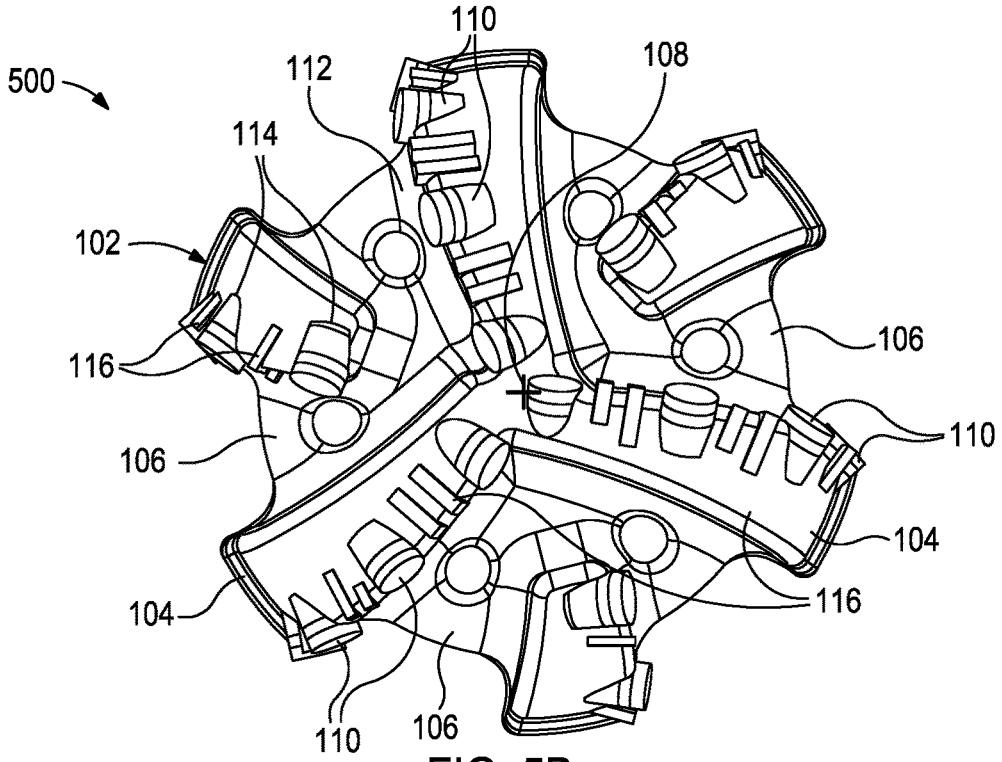

FIGS. 5A and 5B are isometric and top views, respectively, of another example drill bit 500 that may incorporate one or more principles of the present disclosure. The drill bit 500 may be similar in some respects to the drill bits 100, 300, and 400 discussed herein, and therefore may be best understood with reference thereto, where like numerals will represent like components not described again in detail. Similar to the drill bits 100, 300, and 400, for instance, the drill bit 500 includes the bit body 102, the blades 104, and one or more cutting elements 110 mounted to the leading face 112 of one or more of the blades 104 within corresponding cutter pockets 114.

In contrast to the drill bits 100, 300, and 400, however, one or more of the blades 104 and the junk slots 106 in the drill bit 500 may extend to at or near the centerline 108, and the cutting elements 110 may be positioned on the blades 104 across all of the cone, nose, shoulder, and gauge sections 202-208 (FIG. 2) of the bit body 102. Moreover, the milling elements 116 may also be positioned on the blades 104 across all of the cone, nose, shoulder, and gauge sections 202-208 of the bit body 102. In the illustrated embodiment, the arrangement of cutting and milling elements 110, 116 on blades 104 extending to the centerline 108 may alternate along the profile of the bit body 102 extending from the cone section 202 toward the gauge section 208. Accordingly, the drill bit 500 may be useful in drilling solid core well isolation devices that contain harder materials throughout the body of the plug by length and diameter, such as cast iron frac plugs.

Figure 6A:
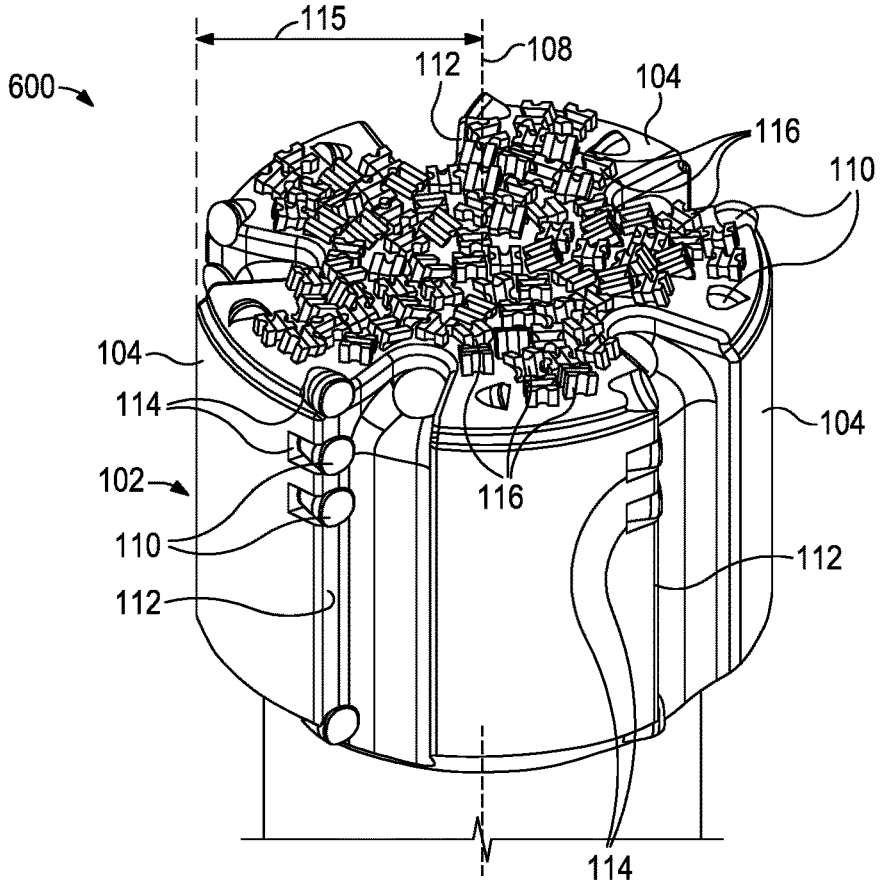
FIGS. 6A and 6B are isometric and top views, respectively, of another example drill bit that may incorporate one or more principles of the present disclosure.
Figure 6B:
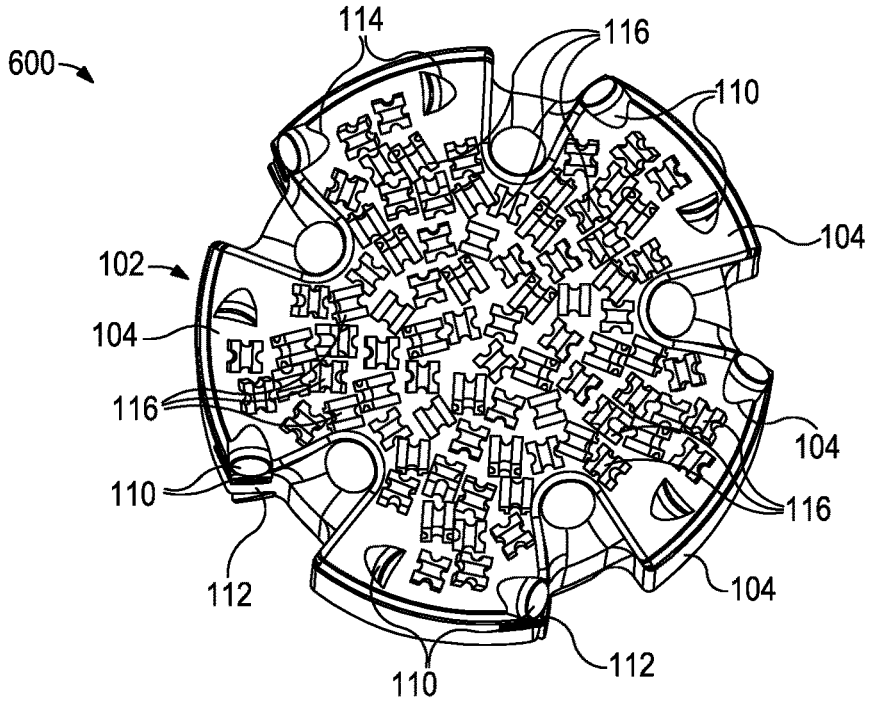

FIGS. 6A and 6B are isometric and top views, respectively, of another example drill bit 600 that may incorporate one or more principles of the present disclosure. The drill bit 600 may be similar in some respects to the drill bits 100, 300, 400, and 500 discussed herein, and therefore may be best understood with reference thereto, where like numerals represent like components not described again. Similar to the drill bits 100, 300, 400, and 500, for instance, the drill bit 600 includes the bit body 102, the blades 104, and one or more cutting elements 110 mounted to the leading face 112 of one or more of the blades 104 within corresponding cutter pockets 114.

Figure 7:
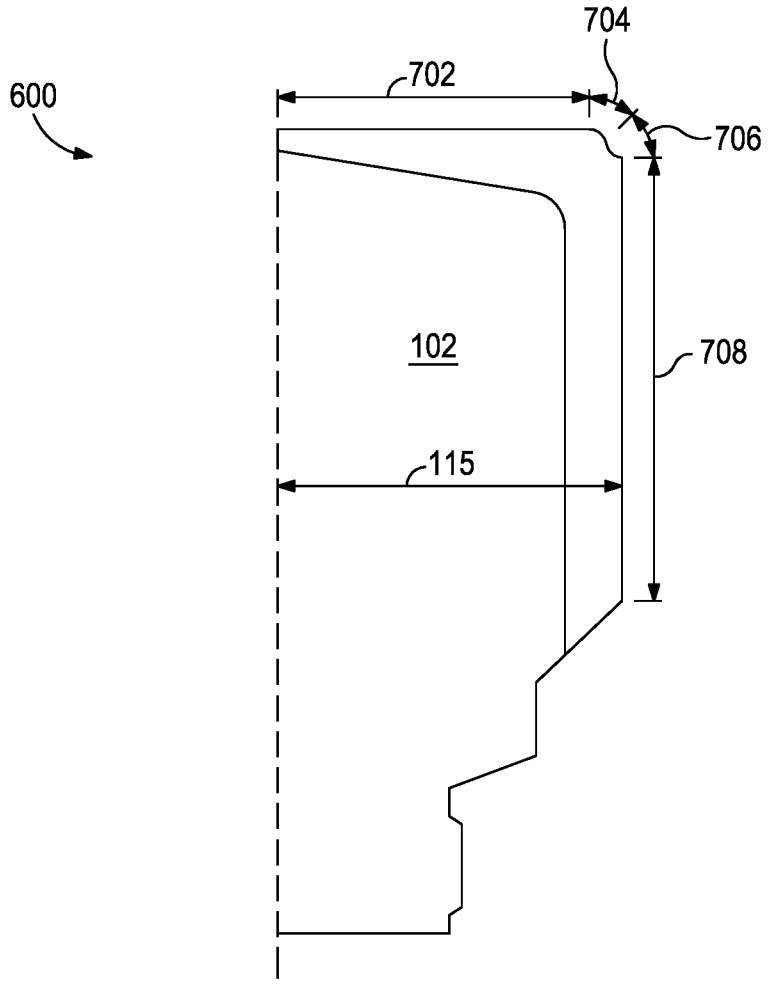
FIG. 7 is a schematic representation of the profile of the drill bit of FIGS. 6A-6B.

Referring briefly to FIG. 7, illustrated is a schematic representation of the profile of the drill bit 600. As illustrated, the bit body 102 includes a cone section 702, a nose section 704, a shoulder section 706, and a gauge section 708. The cone, nose, shoulder, and gauge sections 702-708 form contiguous portions of the bit profile extending radially outward from the centerline 108. More specifically, the cone section 702 extends from the centerline 108 a first distance, the nose section 704 extends from the cone section 702 a second distance, the shoulder section 706 extends from the nose section 704 a third distance, and the gauge section 708 extends from the shoulder section 706 a fourth distance.

In the illustrated embodiment, the cone section 702 is generally planar (e.g., substantially flat) across the distal end of the bit body 102. Moreover, the first distance of the cone section 702 encompasses a majority of the radius 115 of the bit body. In some embodiments, for example, the first distance may comprise ¾ of the bit radius 115 extending from the centerline 108. In other embodiments, the first distance may comprise ⅞ of the bit radius 115 extending from the centerline 108. In comparison, the combined distances of the nose, shoulder and gauge sections 704-708 may comprise ¼ or ⅛ of the bit radius 115. In some embodiments, the nose section 704 may be substantially absent or indiscernible from the cone and/or shoulder sections 702, 706.

Referring again to FIGS. 6A-6B, the cutting elements 110 are arranged on the bit body 102 generally outside of the cone section 702 (FIG. 7), thus making the cone section 702 substantially void of cutter pockets 114. Accordingly, the cutting elements 110 may be positioned on the bit body 102 on the outer ¼ to outer ⅛ (and any fraction therebetween) of the bit radius 115 extending from the centerline 108, but are not present (void) within the inner ¾ to inner ⅞ (and any fraction therebetween) of the bit radius 115.

Moreover, the milling elements 116 are mounted or otherwise secured to the bit body 102 adjacent the centerline 108 and generally situated only within the cone section 702 (FIG. 7). In the illustrated embodiment, the milling elements 116 are arranged randomly (asymmetrically) within the cone section 702, but could alternatively be arranged in a predetermined pattern or design.

In some embodiments, as illustrated, the position or arrangement of some of the cutting and milling elements 110, 116 may angularly overlap. More particularly, some of the cutting and milling elements 110, 116 may be positioned to occupy the same radial line about the circumference of the bit body 102. In the illustrated embodiment, for example, one or more cutting elements 110 positioned on a particular bit blade 104 are angularly followed by one or more milling elements 116 positioned on the same bit blade 104, and the milling elements 116 are angularly followed by one or more additional cutting elements 110 positioned on the same bit blade 104. This pattern may be repeated on all bit blades 104 extending about the circumference of the bot body 102. As a result, when the bit body 102 rotates during operation, the milling elements 116 will track the cutting elements 110 in the same radial line, thus serving as secondary or back-up cutters. Placement of the cutting and milling elements 110, 116 may alternatively alternate in an angular direction extending about the circumference of the bit body 102 at specific radial locations within the nose section 204.

The embodiment of FIGS. 6A-6B may be advantageous in creating a redundancy of durable cutting elements 110 and sharp milling elements 116 on same portions of profile/radial positions. Additionally, this embodiment would provide a balance of the more aggressive milling elements and more durable cutting elements across the entire profile to provide optimal cutting sizes and durability as various materials move about the face of the bit during the drilling operation. Alternating patterns of cutting and milling elements 110, 116 optimize torque signatures, cutting size, and durability by increasing or decreasing the amount of cutting elements 110.

Figure 8A:
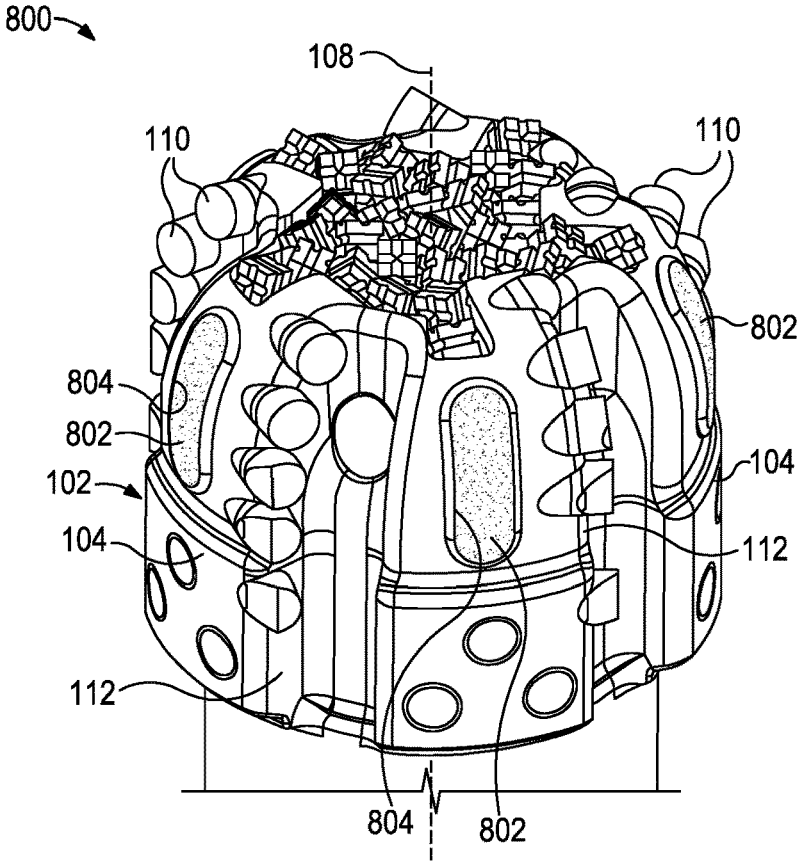
FIGS. 8A and 8B are isometric and top views, respectively, of another example drill bit that may incorporate one or more principles of the present disclosure.
Figure 8B:
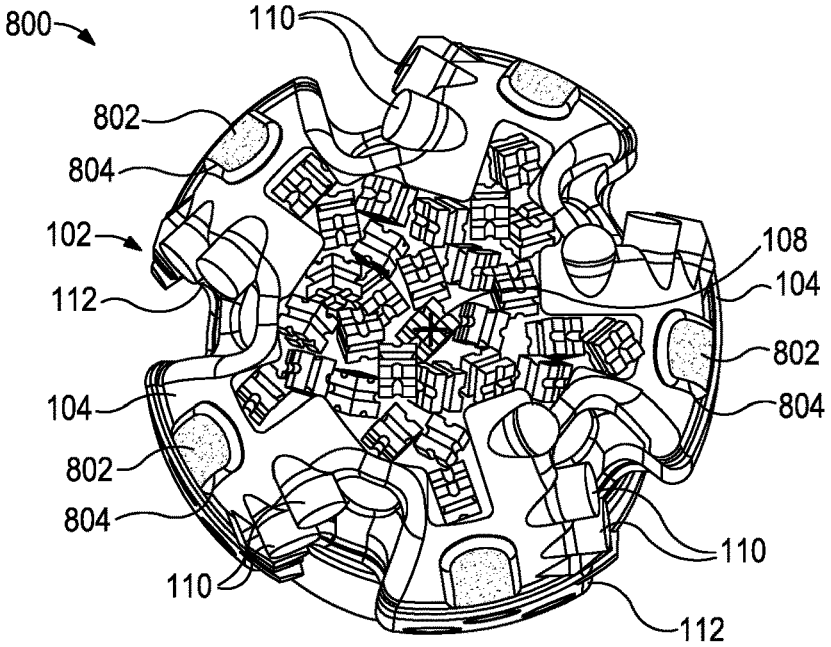

FIGS. 8A and 8B are isometric and top views, respectively, of another example drill bit 800 that may incorporate one or more principles of the present disclosure. The drill bit 800 may be similar in some respects to the drill bits 100, 300, 400, 500, and 600 discussed herein, and therefore may be best understood with reference thereto, where like numerals represent like components not described again. Similar to the drill bits 100, 300, 400, 500, and 600, for instance, the drill bit 800 includes the bit body 102, the blades 104, and one or more cutting elements 110 mounted to the leading face 112 of one or more of the blades 104.

Moreover, similar to the drill bits 100, 300, 400, 500, and 600, the drill bit 800 includes the milling elements 116 mounted or otherwise secured to the bit body 102 adjacent the centerline 108 and generally situated within the cone section 202, 702 (FIGS. 2 and 7). In some cases, some of the milling elements 116 may be positioned in the nose section 204, 704, (FIGS. 2 and 7). The milling elements 116 may be arranged randomly (asymmetrically) or in a predetermined pattern or design. Moreover, in some embodiments, the position or arrangement of some of the cutting and milling elements 110, 116 may angularly overlap. In the illustrated embodiment, for instance, some of the cutting and milling elements 110, 116 may be positioned to occupy the same radial line about the circumference of the bit body 102. In the illustrated embodiment, for example, one or more cutting elements 110 arranged on one bit blade 104 are angularly followed by one or more milling elements 116 positioned on the same bit blade 104, which are angularly followed by one or more additional cutting elements 110 arranged on another angularly adjacent bit blade 104.

Unlike the drill bits 100, 300, 400, 500, and 600, however, the drill bit 800 may further include backup milling elements 802 positioned on each blade 104. The backup milling elements 802 may comprise, for example, crushed carbide, polycrystalline diamond (PCD), tungsten carbide, thermally stable polycrystalline (TSP), polycrystalline boron nitride, cubic boron nitride, natural or synthetic diamond, hardened steel, or any combination thereof brazed or welded to the blades 104 and arranged to angularly follow one or more cutting elements 110 positioned at the leading face 112 of the corresponding blade 104. In some embodiments, an impression or pocket 804 may be formed or otherwise defined each blade 104, and the backup milling elements 802 may be arranged within the pockets 804. The drill bit 800 may prove advantageous in providing a redundancy of sharp milling elements 802 and durable cutting elements 110 across the same portion of the profile/radial position.

In another embodiment, one or more of the pockets 804 formed on the blades 104 may alternatively be filled by welding hardfacing into the pocket 804. In such embodiments, the hardfacing may act as a bearing surface to help protect against damaging the inner walls of the surrounding casing while drilling a bridge plug or a frac plug.

Figure 9:
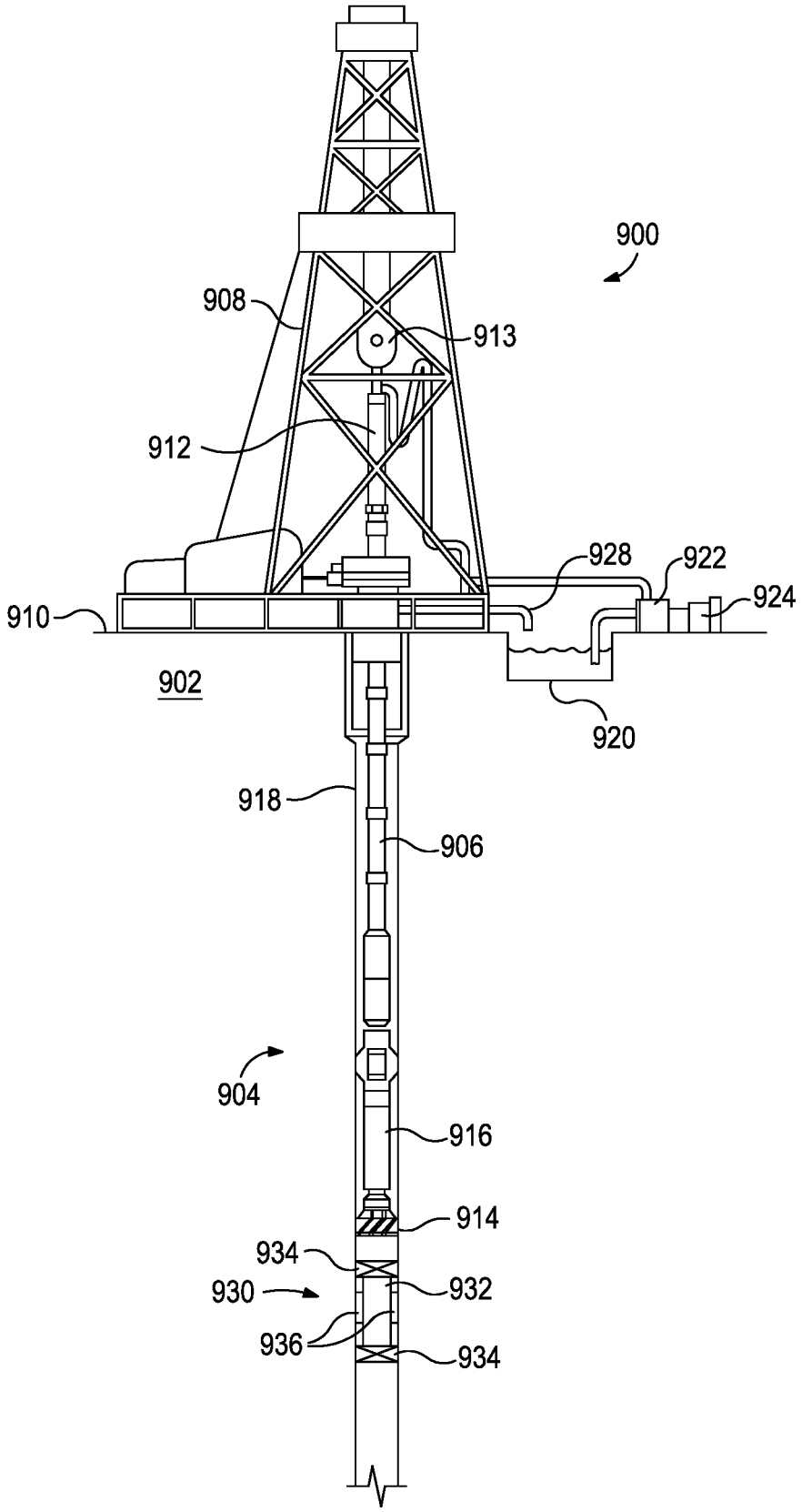
FIG. 9 is a schematic diagram of an example drilling system that may employ one or more principles of the present disclosure.

FIG. 9 is a schematic diagram of an example drilling system 900 that may employ one or more principles of the present disclosure. Boreholes may be created by drilling into the earth 902 using the drilling system 900. The drilling system 900 may be configured to drive a bottom hole assembly (BHA) 904 positioned or otherwise arranged at the bottom of a drill string 906 extended into the earth 902 from a derrick 908 arranged at the surface 910. The derrick 908 includes a kelly 912 and a traveling block 913 used to lower and raise the kelly 912 and the drill string 906.

The BHA 904 may include a drill bit 914 operatively coupled to a tool string 916 which may be moved axially within a drilled wellbore 918 as attached to the drill string 906. The drill bit 914 may be the same as or similar to any of the drill bits 100, 300, 400, 500, 600, and 800 described herein. In operation, fluid or "mud" from a mud tank 920 may be pumped downhole using a mud pump 922 powered by an adjacent power source, such as a prime mover or motor 924. The mud may be pumped from the mud tank 920, through a stand pipe 926, which feeds the mud into the drill string 906 and conveys the same to the drill bit 914. The mud exits one or more nozzles arranged in the drill bit 914 and in the process cools the drill bit 914. After exiting the drill bit 914, the mud circulates back to the surface 910 via the annulus defined between the wellbore 918 and the drill string 906, and in the process returns drill cuttings and debris to the surface. The cuttings and mud mixture are passed through a flow line 928 and are processed such that a cleaned mud is returned down hole through the stand pipe 926 once again.

In some applications, a wellbore isolation device 930 may be arranged or otherwise set within the wellbore 918 and the drill bit 914 may be advanced within the wellbore 918 to drill and/or mill out the wellbore isolation device 930. The wellbore isolation 930 may comprise, for example, a bridge plug or a frac plug, and can be manufactured from a variety of materials, including various metals, ceramics, and elastomeric (e.g., resilient) elements. As illustrated, the wellbore isolation device 930 may include a main body 932 made of cast iron, a composite material, or another easily drillable (millable) material. One or more packing elements 934 encircle the body 932 and are actuatable to form a hydraulic seal within the wellbore. The packing elements 934 may be made of an elastomer that is squeezed to expand during the setting operation, though inflatable packing elements can also be used. The wellbore isolation device 930 may also include one or more slips 936 positioned along the outer diameter of the body 932 to engage and dig into the inner wall of the wellbore 918 (or casing) and thereby anchor the wellbore isolation device 930 axially in position. The slips 936 may be made of hard materials, such as steel, cast iron, ceramic, or tungsten carbide.

Similar to the drill bits 100, 300, 400, 500, 600, and 800 described herein, the drill bit 914 may including cutting elements (e.g., cutting elements 110) positioned primarily near the outer diameter of the bit body (e.g., bit body 102), thus being in position to engage and mill through the harder materials of the wellbore isolation device 930, such as the slips 930. Moreover, the drill bit may include milling elements (e.g., milling elements 116) generally positioned nearer to or adjacent the centerline of the drill bit 914, thus being positioned to engage and mill through the softer materials of the wellbore isolation device 930, such as the body 932 and the packing elements 934.

Although the drilling system 900 is shown and described with respect to a rotary drill system in FIG. 9, those skilled in the art will readily appreciate that many types of drilling systems can be employed in carrying out embodiments of the disclosure. For instance, drills and drill rigs used in embodiments of the disclosure may be used onshore (as depicted in FIG. 9) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent. Moreover, the drill bits described herein may be advanced downhole by any conveyance means known in the art including, but not limited to, drill pipe and coiled tubing.

Embodiments Disclosed Herein Include

A. A drill bit that includes a bit body providing one or more blades and defining a cone section extending from a centerline of the bit body a first distance, a nose section extending from the cone section a second distance, a shoulder section extending from the nose section a third distance, and a gauge section extending from the shoulder section a fourth distance, one or more cutting elements mounted to the one or more blades outside of the cone section such that the cone section is void of cutting elements, and a plurality of milling elements secured to the bit body within the cone section.

B. A method of using a drill bit including the steps of introducing the drill bit into a wellbore, the drill bit including a bit body providing one or more blades and defining a cone section extending from a centerline of the bit body a first distance, a nose section extending from the cone section a second distance, a shoulder section extending from the nose section a third distance, and a gauge section extending from the shoulder section a fourth distance, one or more cutting elements mounted to the one or more blades outside of the cone section such that the cone section is void of cutting elements, and a plurality of milling elements secured to the bit body within the cone section. The method further including advancing the drill bit to a wellbore isolation device anchored within the drill bit, and drilling and milling through the wellbore isolation device with the drill bit.

C. A drill bit that includes a bit body having a centerline and providing one or more blades, one or more cutting elements mounted to each blade and each cutting element being received within and bonded to a dedicated cutter pocket defined by the bit body, and a plurality of milling elements secured to flat, outer surfaces of each blade, wherein the one or more cutting elements and the plurality of milling elements are alternatingly arranged along a length of each blade extending from the centerline.

Each of embodiments A, B, and C may have one or more of the following additional elements in any combination: Element 1: wherein the one or more cutting elements are positioned on the bit body only on an outer ½ of a bit radius extending from the centerline. Element 2: wherein the one or more cutting elements are positioned on the bit body only on an outer ¾ of a bit radius extending from the centerline. Element 3: wherein the one or more cutting elements are positioned on the bit body only on an outer ⅞ of a bit radius extending from the centerline. Element 4: wherein the plurality of milling elements is arranged asymmetrically. Element 5: wherein the plurality of milling elements is arranged in a predetermined pattern. Element 6: wherein the predetermined pattern comprises concentric circles extending radially outward from the centerline. Element 7: wherein a portion of the one or more cutting elements and a portion of the plurality of milling elements are positioned separately on alternating blades of the one or more blades in a same radial line about a circumference of the bit body. Element 8: wherein some of the portion of the plurality of milling elements are arranged on a leading face of the one or more blades and serve as primary cutters. Element 9: further comprising at least one of the one or more cutting elements positioned on a particular bit blade of the one or more blades, one or more of the plurality of milling elements positioned on the particular blade and angularly following the at least one of the one or more cutting elements in a same radial line, and at least one additional one of the one or more cutting elements positioned on the particular bit blade and angularly following the one or more of the plurality of milling elements in the same radial line. Element 10: further comprising a backup milling element positioned on at least one of the one or more blades and angularly following at least one of the one or more cutting elements. Element 11: wherein at least one of the one or more blades extends to a centerline of the bit body.

Element 12: wherein the wellbore isolation device includes a body and one or more slips positioned about an outer diameter of the body, and wherein the one or more cutting elements are positioned on the bit body only on an outer ½ of a bit radius extending from the centerline, the method further comprising drilling and milling through the slips with the one or more cutting elements, and milling through the body with the plurality of milling elements. Element 13: wherein a portion of the one or more cutting elements and a portion of the plurality of milling elements are positioned separately on alternating blades of the one or more blades in a same radial line about a circumference of the bit body. Element 14: wherein the drill bit further includes at least one of the one or more cutting elements positioned on a particular bit blade of the one or more blades, one or more of the plurality of milling elements positioned on the particular blade and angularly following the at least one of the one or more cutting elements in a same radial line, and at least one additional one of the one or more cutting elements positioned on the particular bit blade and angularly following the one or more of the plurality of milling elements in the same radial line. Element 15: wherein the drill bit further includes a backup milling element positioned on at least one of the one or more blades and angularly following at least one of the one or more cutting elements, the method further comprising milling through the slips with the backup milling element.

Element 16: wherein the one or more cutting elements and the plurality of milling elements are arranged in alternating angular positions about a circumference of the bit body and along the length of each blade extending from the centerline. Element 17: wherein a milling element of the plurality of milling elements on a first blade is positioned to radially and angularly align with a cutting element of the one or more cutting elements on a second blade angularly adjacent to the first blade.

By way of non-limiting example, exemplary combinations applicable to A, B, and C include: Element 1 with Element 2; Element 1 with Element 3; Element 5 with Element 6; and Element 7 with Element 8.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A drill bit, comprising:

a bit body providing one or more blades and defining a cone section extending from a centerline of the bit body a first distance, a nose section extending from the cone section a second distance, a shoulder section extending from the nose section a third distance, and a gauge section extending from the shoulder section a fourth distance;

one or more cutting elements mounted to the one or more blades, each cutting element being received within and bonded to a dedicated cutter pocket defined by the bit body, wherein each cutting element is mounted outside of the cone section such that the cone section is void of cutting elements and cutter pockets; and a plurality of milling elements secured to the bit body within the cone section and further secured to the one or more blades offset from a leading face thereof within at least one of the nose, shoulder, and gauge sections, wherein each milling element is made of a wear-resistant material exhibiting jagged or sharp geometry.

2. The drill bit of claim 1, wherein the one or more cutting elements are positioned on the bit body only on an outer ½ of a bit radius extending from the centerline.

3. The drill bit of claim 2, wherein the one or more cutting elements are positioned on the bit body only on an outer ¾ of a bit radius extending from the centerline.

4. The drill bit of claim 2, wherein the one or more cutting elements are positioned on the bit body only on an outer ⅞ of a bit radius extending from the centerline.

5. The drill bit of claim 1, wherein the plurality of milling elements is arranged asymmetrically.

6. The drill bit of claim 1, wherein the plurality of milling elements is arranged in a predetermined pattern.

7. The drill bit of claim 6, wherein the predetermined pattern comprises concentric circles extending radially outward from the centerline.

8. The drill bit of claim 1, wherein at least one of the one or more blades extends to a centerline of the bit body.

9. The drill bit of claim 1, wherein the cone section is flat.

10. The drill bit of claim 1, wherein the one or more blades are separated by junk slots, and each junk slot extends into the cone section.

11. The drill bit of claim 1, wherein the cone section extends to an outer ⅞ of a bit radius extending from the centerline.

12. A method of using a drill bit, comprising:

introducing the drill bit into a wellbore, the drill bit including:

a bit body providing one or more blades and defining a cone section extending from a centerline of the bit body a first distance, a nose section extending from the cone section a second distance, a shoulder section extending from the nose section a third distance, and a gauge section extending from the shoulder section a fourth distance;

one or more cutting elements mounted to the one or more blades, each cutting element being received within and bonded to a dedicated cutter pocket defined by the bit body, wherein each cutting element is mounted outside of the cone section such that the cone section is void of cutting elements and cutter pockets; and a plurality of milling elements secured to the bit body within the cone section and further secured to the one or more blades offset from a leading face thereof within at least one of the nose, shoulder, and gauge sections, each milling element being made of a wear-resistant material exhibiting jagged or sharp geometry;

advancing the drill bit to a wellbore isolation device anchored within the wellbore; and drilling and milling through the wellbore isolation device with the drill bit.

13. The method of claim 12, wherein the wellbore isolation device includes a body and one or more slips positioned about an outer diameter of the body, and wherein the one or more cutting elements are positioned on the bit body only on an outer ½ of a bit radius extending from the centerline, the method further comprising:

drilling and milling through the slips with the one or more cutting elements; and milling through the body with the plurality of milling elements.

14. A drill bit, comprising:

a bit body providing one or more blades and defining a cone section extending from a centerline of the bit body a first distance, a nose section extending from the cone section a second distance, a shoulder section extending from the nose section a third distance, and a gauge section extending from the shoulder section a fourth distance;

one or more cutting elements mounted to the one or more blades, each cutting element being received within and bonded to a dedicated cutter pocket defined by the bit body, wherein each cutting element is mounted outside of the cone section such that the cone section is void of cutting elements and cutter pockets; a plurality of milling elements secured to the bit body within the cone section such that the nose, shoulder, and gauge sections are each void of the plurality of milling elements, wherein each milling element is made of a wear-resistant material exhibiting jagged or sharp geometry.

* * * * *